US012687112B2

(12) United States Patent
Wang et al.

(10) Patent No.: US 12,687,112 B2
(45) Date of Patent: Jul. 21, 2026

(54) FLEXIBLE ELECTRODE TUBE FOR ELECTRIFIED RARE EARTH MINING AND APPLICATION METHOD THEREFOR

(71) Applicant: Guangzhou Institute of Geochemistry, Chinese Academy of Sciences, Guangzhou (CN)

(72) Inventors: Gaofeng Wang, Guangzhou (CN); Yongqiang Yang, Guangzhou (CN); Jianxi Zhu, Guangzhou (CN); Xiaoliang Liang, Guangzhou (CN); Hongping He, Guangzhou (CN); Jie Xu, Guangzhou (CN); Jingming Wei, Guangzhou (CN)

(73) Assignee: Guangzhou Institute of Geochemistry, Chinese Academy of Sciences, Guangzhou (CN)

( * ) Notice: Subject to any disclaimer, the term of this patent is extended or adjusted under 35 U.S.C. 154(b) by 24 days.

(21) Appl. No.: 19/266,102

(22) Filed: Jul. 10, 2025

(65) Prior Publication Data

US 2026/0043328 A1 Feb. 12, 2026

(30) Foreign Application Priority Data

Aug. 8, 2024 (CN) ..... 202411084735.7

(51) Int. Cl.

| | |
|---|---|
| ***E21C 41/22*** | (2006.01) |
| ***C22B 3/04*** | (2006.01) |
| ***C22B 59/00*** | (2006.01) |
| ***E21B 43/28*** | (2006.01) |

(52) U.S. Cl.

CPC ..... *E21C 41/22* (2013.01); *C22B 3/045* (2013.01); *E21B 43/28* (2013.01); *C22B 59/00* (2013.01)

(58) Field of Classification Search

CPC ..... E21C 41/22; C22B 3/045; C22B 59/00; E21B 43/28

See application file for complete search history.

(56) References Cited

U.S. PATENT DOCUMENTS 9,989,664 B2 * 6/2018 Campbell ..... E02F 3/8866
2014/0339086 A1 * 11/2014 He ..... B09C 1/085 204/628

FOREIGN PATENT DOCUMENTS

| | | | |
|---|---|---|---|
| CN | 104088272 A | | 10/2014 |
| CN | 112921193 A | | 6/2021 |
| CN | 117230327 A | * | 12/2023 |
| CN | 221072572 U | | 6/2024 |

* cited by examiner

*Primary Examiner* — Janine M Kreck

(57) ABSTRACT

Disclosed is a flexible electrode tube for electrified rare earth mining and an application method therefor. Flexible conductive plastic tubes, wires, and joint zones are included, outer walls of the flexible conductive plastic tubes are smooth, with spiral wires embedded inside tube walls, and the wires are led out at the joint zones and connected to cables. The method includes the steps of: S1, drilling fluid injection holes; S2, placing the flexible electrode tubes into bottoms of the fluid injection holes; S3, mounting fluid injection tubes; S4, connecting the wires and the cables to a direct current (DC) power supply, and fixing ropes connecting clamps; and S5, extracting the flexible electrode tubes by pulling the ropes for subsequent reuse after mining completion. The present disclosure has the advantages of excellent electrical conductivity, corrosion resistance, high strength, and ease of arrangement and retrieval.

8 Claims, 2 Drawing Sheets

FLEXIBLE ELECTRODE TUBE FOR ELECTRIFIED RARE EARTH MINING AND APPLICATION METHOD THEREFOR

CROSS-REFERENCE TO RELATED APPLICATIONS

This application claims priority of Chinese Patent Application No. 202411084735.7 filed on Aug. 8, 2024, the entire contents of which are incorporated herein by reference.

TECHNICAL FIELD

The present disclosure relates to the technical field of ionic rare earth mining, and in particular to a flexible electrode tube for electrified rare earth mining and an application method therefor.

BACKGROUND

Ionic rare earth ores, primarily distributed in southern China, are enriched with high-value medium-heavy rare earth elements and constitute a critical strategic resource for China. However, a conventional ammonium sulfate in-situ leaching process exhibits prolonged mining cycles and low rare earth recovery rates, causing significant resource waste. More critically, this process induces severe ammonia-nitrogen pollution in mining areas and surrounding water bodies, requiring substantial human and financial resources for remediation. As a result, the newly approved rare earth mining licenses have banned the use of this process, while existing ionic rare earth mines are generally suspended for rectification. Therefore, the development of green and efficient new mining processes for ionic rare earth ores is of great significance.

A Chinese patent CN109402417A provides an electrified mining method for rare earth ores, which primarily involves inserting anode fluid injection tubes and cathode fluid collection tubes into a rare earth ore body; and applying direct current (DC) between the anode fluid injection tubes and the cathode fluid collection tubes to accelerate leaching agent migration, thereby shortening mining time, improving mining efficiency, while reducing environmental pollution and geological disasters. This process has a good application prospect As core materials for electrified rare earth mining systems, the anode fluid injection tubes and the cathode fluid collection tubes largely determine mining costs and efficiency of the systems. A conductive plastic drainage board (as described in CN102720182A) and a plastic electrode tube for electro-osmosis drainage (CN104088272A) overcome corrosion and fuse-prone defects of traditional metal electrodes, having gained extensive application in drainage consolidation projects.

However, when directly applied to electrified rare earth mining, the above electrodes exhibit suboptimal efficiency. More critically, these electrodes fail to meet requirements for electrode recovery and reuse, resulting in high mining costs. Therefore, further optimization of electrode material formulations is required to achieve a synergistic balance between conductivity, corrosion resistance, and structural strength, thereby enhancing mining efficiency. Additionally, the optimization of arrangement methods is required to facilitate intact retrieval from fluid injection holes post-mining for reuse, thereby reducing mining costs.

SUMMARY

An objective of the present disclosure is to provide a flexible electrode tube for electrified rare earth mining and an application method therefor, to solve the deficiencies existing in the above related art, achieving synergistic integration of conductivity, corrosion resistance, and tensile strength, and optimizing arrangement methods, thereby improving the mining efficiency while reducing costs.

The present disclosure employs the following technical solutions.

A flexible electrode tube for electrified rare earth mining includes a flexible conductive plastic tube, a wire, and a joint zone, the flexible conductive plastic tube and the joint zone are integrally formed, and the joint zone has a plurality of annular grooves, the wire exhibits low resistivity and is embedded inside a tube wall of the flexible conductive plastic tube in a spiral manner, uniformly distributed from top to bottom, thereby causing the wire to uniformly and efficiently transmit current throughout the entire tube wall, significantly shortening a current transmission distance within the high-resistance flexible conductive plastic tube, and reducing the overall resistance of the flexible electrode tube.

Note: the wire has low resistance, while the flexible conductive plastic tube exhibits high resistance. Current is primarily transmitted through the wire. Due to the wire being uniformly embedded inside the flexible electrode tube in a spiral manner, uniform current distribution is ensured in the flexible conductive plastic tube close to the wire. Compared to directly using high-resistance flexible conductive plastic tubes, the current transmission distance within the tubes is shortened. Consequently, the overall resistance of the flexible conductive plastic tubes is reduced relative to flexible plastic tubes without the embedded-wire design.

Preferably, during mining, the conductor wires are connected to waterproof snap-fit joints through the cables, the waterproof snap-fit joints are connected to an n-to-1 waterproof connector, the n-to-1 waterproof connector is connected to a DC power supply through the cables, a portion of the flexible electrode tubes are connected to the positive terminal of the DC power supply, and the remaining flexible electrode tubes are connected to the negative terminal of the DC power supply, with equal numbers of tubes connected to the positive terminal and the negative terminal.

Preferably, the flexible conductive plastic tube features an open bottom configuration and a smooth outer wall, with the wire being a single metal wire.

Preferably, the flexible conductive plastic tube has an outer diameter of 40-80 mm, a wall thickness of 2-4 mm, and a tube length of 3-21 m; and Preferably, the flexible conductive plastic tube is made from polyethylene, polypropylene, carbon black and graphite, with a mass ratio of 1:0.1-0.2:0.4-0.5:0.1-0.2, and exhibits a resistivity below $10^{-3}$ Ω·m.

Preferably, the wire is copper or aluminum wires, with a cross-sectional area spanning $0.78^{-6}$ $mm^2$.

Preferably, the spiral wire embedded inside the flexible conductive plastic tube has a lead pitch of 30-80 mm.

Preferably, the joint zone is made from polyethylene, polypropylene, carbon black and graphite, with a mass ratio of 1:0.4-0.6:0.4-0.5:0.1-0.2, and exhibits a resistivity below $5\times10^{-3}$ Ω·m.

Preferably, the joint zone has a length of 0.2-0.5 m, an outer diameter of 30-70 mm, a wall thickness of 10-20 mm; and 2-5 annular grooves are arranged on its outer wall, each having a depth of 4-15 mm and a width of 20-40 mm.

Preferably, the grooves have clamps, and ropes for pulling are fixed to the clamps.

Preferably, after being led out from a top of the flexible conductive plastic tube, the wire is connected to the cable, with waterproofing applied to its exposed section and joint.

Preferably, the flexible electrode tube can be wounded onto a winding machine for convenient transport.

Preferably, the flexible electrode tube is arranged within an orebody layer, while a topsoil layer above it remains free of any tubes.

An application method for a flexible electrode tube for electrified rare earth mining includes the steps of:

S1, drilling liquid injection holes in a mining area, each with a diameter of 40-80 mm, and a bottom positioned 1-2 m above a bottom of a rare earth ore body, this height difference ensuring uniform distribution of leaching agents, while enhancing the electric field's effectiveness in promoting rare earth migration;

S2, slowly placing flexible electrode tubes into the bottoms of the liquid injection holes, with top ends located at an interface between a rare earth orebody layer and a topsoil layer;

S3, inserting fluid injection tubes (with diameters of 10-20 mm) into the liquid injection holes to lengths precisely reaching joint zones of the flexible electrode tubes, the fluid injection tubes serving primarily to introduce leaching agents into the flexible electrode tubes;

S4, fixing ropes connecting clamps to ground stand columns, inserting waterproof snap-fit joints of n cables into an n-to-1 waterproof connector (in which $1<n<10$), transferring this connector to a main cable and connecting it to the corresponding positive or negative terminal of a DC power supply, and performing electrified rare earth mining according to corresponding processes; and S5, unplugging the cables of the flexible electrode tubes from the n-to-1 waterproof connector after mining completion, pulling out the fluid injection tubes, and extracting the flexible electrode tubes from the liquid injection holes by pulling the ropes for later use.

The present disclosure has the following beneficial effects.

(1) Achievement a Balance of Conductivity, Corrosion Resistance, and Tensile Strength The flexible electrode tubes are made from polyethylene, polypropylene, carbon black, and graphite. Polypropylene can enhance the tensile strength of materials, while polyethylene improves the aging resistance and flexibility of materials. Carbon black and graphite can enhance the conductivity of materials. The spiral wires embedded inside the flexible conductive plastic tubes can facilitate efficient and uniform current distribution across the entire electrode tube, reducing energy loss and enhancing the efficiency of electrified rare earth mining.

(2) Simple Arrangement for Easy Retrieval and Reuse and Lightweight Material for Easy Transport The flexible electrode tubes provided in the present disclosure feature smooth outer walls with the joint zones. Each joint zone has the annular grooves on its outer wall. The grooves have the clamps, and the ropes for pulling are fixed to the clamps. After electrified mining, the flexible electrode tubes can be pulled out of the fluid injection holes by pulling the ropes, thereby achieving reuse. Furthermore, the flexible electrode tubes, exhibiting a stiffness intermediate between a flexible tube and a rigid tube, can be wounded onto the winding machine for convenient transport. Additionally, the flexible electrode tubes provided in the present disclosure have simple plug-in sockets on all cables connected to the wires. These cables can easily connected to the main cable and DC power supply through the n-to-1 connector.

Figure 1:
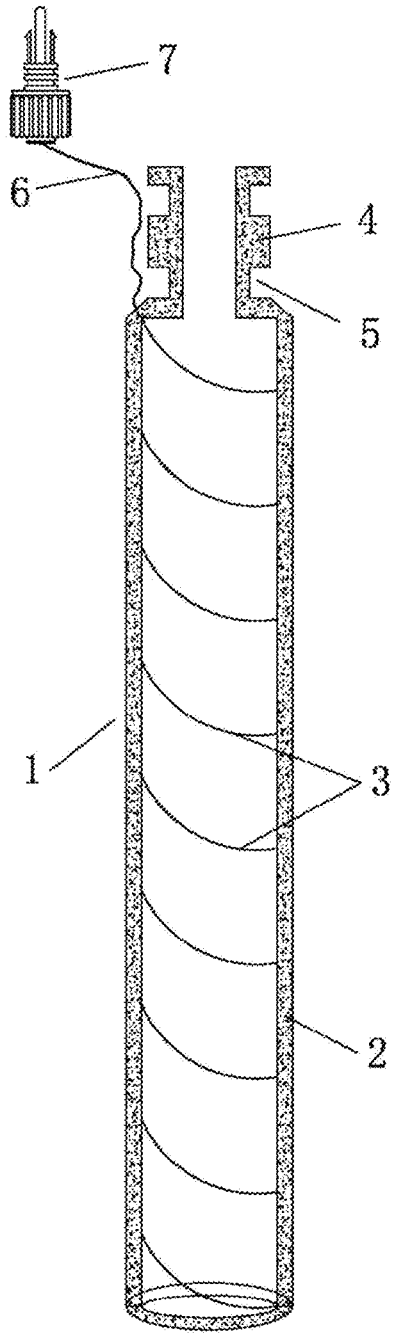
FIG. 1 is a schematic diagram of a flexible electrode tube.

Reference numerals and denotations thereof: 1—flexible electrode tube; 2—flexible conductive plastic tube; 3—wire; 4—joint zone; 5—groove; 6—cable; 7—waterproof snap-fit joint; 8—rope; 9—fluid injection tube; 10—fluid injection hole; 11—topsoil layer; 12—clamp; and 13—orebody layer.

DETAILED DESCRIPTION

In order to make the purpose, technical solutions and advantages of the present disclosure more clear, the technical solutions of the present disclosure are further described clearly and completely below. Obviously, the embodiments described are only some, rather than all embodiments of the present disclosure. Based on the embodiments of the present disclosure, all other embodiments obtained by those ordinary skilled in the art without creative efforts fall within the scope of protection of the present disclosure.

Figure 2:
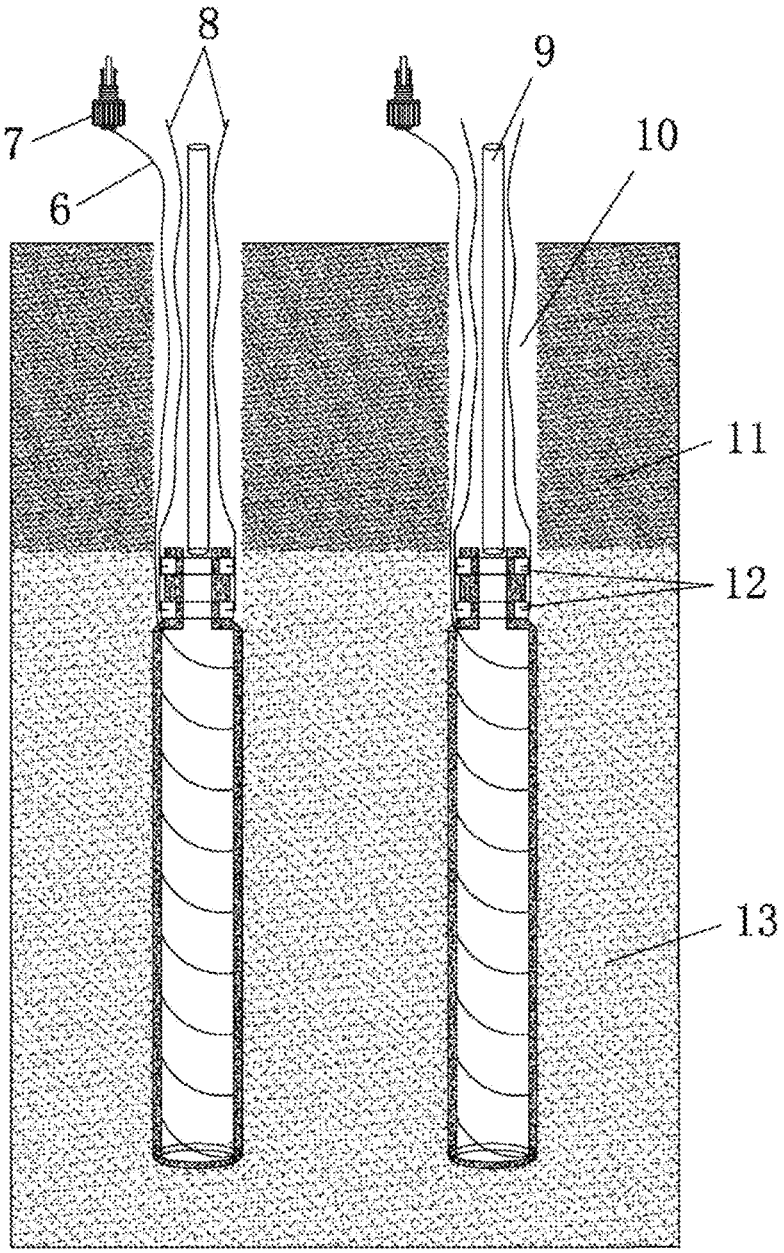
FIG. 2 is a schematic diagram of a flexible electrode tube arrangement method.

Referring to FIGS. 1-2, the present disclosure provides a flexible electrode tube for electrified rare earth mining. Each flexible electrode tube 1 includes a flexible conductive plastic tube 2, a wire 3, and a joint zone 4, an upper portion of the flexible conductive plastic tube 2 and the joint zone 4 are integrally formed, and the wire 3 is embedded inside a tube wall of the flexible conductive plastic tube 2 in a spiral manner. The wire 3 is made using aluminum or copper wires, and both of these two materials demonstrate excellent conductivity. The wire 3 is used for uniformly transmitting current throughout the flexible conductive plastic tube 2, significantly reducing a current transmission distance (limited to a lead pitch of the wire 3) within this conductive plastic material relative to flexible plastic tubes without the embedded-wire design, thereby effectively minimizing the resistance. Moreover, the wire 3 is connected to a waterproof snap-fit joint 7 through a cable 6, thereby ensuring the waterproof performance of the connection. The waterproof snap-fit joint 7 is further connected to an n-to-1 connector, and the n-to-1 connector is connected to a DC power supply through the cable, thereby forming a stable current transport system. A portion of the flexible electrode tubes are connected to the positive terminal of the DC power supply, while an equal number of others are connected to the negative terminal.

In a further description, the flexible conductive plastic tube 2 and the joint zone 4 are made from polyethylene, polypropylene, carbon black and graphite.

In a further description, the flexible conductive plastic tube 2 features an open bottom configuration and a smooth outer wall.

In a further description, the joint zone 4 has a plurality of annular grooves 5, and the grooves have clamps 12.

An application method for a flexible electrode tube for electrified rare earth mining includes the steps that:

In S1, fluid injection holes 10 are drilled. In S2, flexible electrode tubes 1 are inserted into bottoms of the fluid injection holes 10, clamps 12 are mounted on annular grooves 5 of joint zones 4. In S3, fluid injection tubes 9 are mounted at openings of the fluid injection holes 10, and leaching agents are injected. In S4, cables 6 led out at the joint zones 4 are connected to a DC power supply through waterproof snap-fit joints and adapters, and ropes connecting the clamps 12 are fixed to ground stand columns, thereby performing electrified rare earth mining. In S5, after mining completion, the cables 6 of the flexible electrode tubes 1 are unplugged from an n-to-1 waterproof connector, the fluid injection tubes 9 are pulled out, and the flexible electrode tubes 1 are extracted from the liquid injection holes 10 by pulling the ropes.

Embodiment 1

This embodiment provides a flexible electrode tube for electrified rare earth mining. A test mining area covers 90.72 $m^2$, with dimensions of 12.6 m in length and 7.2 m in width. Based on exploration results, a topsoil layer measures 6 m in thickness, with an orebody thickness of 10.5 m. An average grade of ion-adsorption rare earth stands at approximately 500 ppm, yielding a total content of 0.74 t. The flexible conductive plastic tube 2 and the joint zone 4 are made from raw materials: polyethylene, polypropylene, carbon black and graphite, following a mass ratio of 1:0.15:0.45:0.15, and yielding a resistivity of $8.8\times10^{-4}$ Ω·m.

Referring to FIG. 1, the flexible conductive plastic tube 2 has a tube length of 9 m, an outer diameter of 50 mm, and a wall thickness of 3 mm; and the joint zone 4 has a length of 0.3 m, an outer diameter of 40 mm, and a thickness of 12 mm. Additionally, three annular grooves 5 are arranged at the joint zone 4, each with a dimension of 6 mm in depth and 30 mm in width.

The wire 3 is embedded inside a tube wall of the flexible conductive plastic tube 2 in a spiral manner, with a lead pitch of 50 mm. The wire 3 is made from an aluminum wire with a cross-sectional area of 1.5 $mm^2$. The wire 3 is connected to the cable 6 through an aluminum-copper conversion joint. The cable 6 is a ZC-BVVR copper core cable with a 1.5 $mm^2$ cross-sectional area, and a waterproof snap-fit connector 7 is mounted at a distal end of the cable 6.

An application method for a flexible electrode tube for electrified rare earth mining includes the steps that:

In S1, fluid injection holes 10 are drilled manually in a rare earth mining area, each with a diameter of 50 mm and a depth of 15.3 m. A bottom of each fluid injection hole is positioned 1.2 m above a bottom of an orebody layer 13. There are a total of 8 rows and 5 columns of fluid injection holes, each with a consistent spacing of 1.8 m.

In S2, two clamps 12 are fixed to grooves 5 of a joint zone 4, and two ropes 8 are threaded through two ends of the two clamps 12 to facilitate uniform force distribution during pulling, each with a length of 7 m; and a flexible electrode tube 1 is slowly placed at the bottom of the fluid injection hole 10.

In S3, a fluid injection tube 9, with a diameter of 10 mm and a length of 6.3 m, is inserted into the fluid injection hole 10, precisely reaching the joint zone 4.

In S4, the ropes 8 are fixed to a stand column near the fluid injection hole 10; and a waterproof snap-fit connector 7 are inserted into a 5-to-1 waterproof connector, and the four flexible electrode tubes 1 from other fluid injection holes are connected to the same 5-to-1 waterproof connector, and connected to a main cable through the waterproof snap-fit connector 7, with the main cable ultimately connected to the corresponding positive or negative terminal of a DC power supply.

In S5, rare earths are mined according to corresponding processes, yielding a total of 0.68 t over a 45-day period, with a 92% recovery rate and total power consumption of 2200 kW·h.

In S6, after ore mining completion, each cable is unplugged from the 5-to-1 waterproof connector, and the fluid injection tube 9 is pulled out; and the flexible electrode tube is extracted from the liquid injection hole 10 by uniformly pulling the two ropes 8 for next reuse.

Embodiment 2

This embodiment provides a flexible electrode tube for electrified rare earth mining. A test mining area covers 129.6 $m^2$, with dimensions of 14.4 m in length and 9 m in width. Based on exploration results, a topsoil layer measures 5 m in thickness, with an orebody thickness of 7 m. An average grade of ion-adsorption rare earth stands at approximately 600 ppm, yielding a total content of 0.82 t. The flexible conductive plastic tube 2 and the joint zone 4 are made from raw materials: polyethylene, polypropylene, carbon black and graphite, following a mass ratio of 1:0.1:0.4:0.1, and yielding a resistivity of $9.2\times10^{-4}$ Ω·m.

Referring to FIG. 1, the flexible conductive plastic tube 1 has a total length of 6.2 m, in which the flexible conductive plastic tube 2 has a length of 6 m, an outer diameter of 45 mm, and a wall thickness of 3 mm; and the joint zone 4 has a length of 0.2 m, an outer diameter of 35 mm, and a thickness of 10 mm. Additionally, two annular grooves 5 are arranged at the joint zone 4, each with a dimension of 5 mm in depth and 30 mm in width.

The wire 3 is embedded inside a tube wall of the flexible conductive plastic tube 2 in a spiral manner, with a lead pitch of 45 mm. The wire 3 is made from a copper wire with a cross-sectional area of 1 $mm^2$. The cable 6 connected to the wire 3 is a ZC-BVVR copper core cable with a 1.5 $mm^2$ cross-sectional area, and a waterproof snap-fit connector 7 is mounted at a distal end of the cable 6.

An arrangement method for a flexible electrode tube for electrified rare earth mining includes the steps that:

In S1, a total of 54 fluid injection holes 10 are drilled manually in a rare earth mining area, each with a diameter of 45 mm, a depth of 11.2 m, and a consistent spacing of 1.8 m.

In S2, two clamps 12 are fixed to grooves 5 of a joint zone 4, and two ropes 8 are threaded through two ends of the two clamps 12 to facilitate uniform force distribution during pulling, each with a length of 7 m; and a flexible electrode tube 1 is slowly placed at the bottom of the fluid injection hole 10.

In S3, a fluid injection tube 9, with a diameter of 10 mm and a length of 6.3 m, is inserted into the fluid injection hole 10, precisely reaching the joint zone 4.

In S4, the ropes 8 are fixed to a stand column near the fluid injection hole 10; a waterproof snap-fit connector 7 are inserted into a 6-to-1 waterproof connector, and the five flexible electrode tubes 1 from other fluid injection holes are connected to the same 6-to-1 waterproof connector, and connected to a main cable through the waterproof snap-fit connector 7, with the main cable ultimately connected to the corresponding positive or negative terminal of a DC power supply.

In S5, rare earths are mined according to corresponding processes, yielding a total of 0.77 t over a 40-day period, with a 94% recovery rate and total power consumption of 2350 kW·h.

In S6, after ore mining completion, each cable is unplugged from the 6-to-1 waterproof connector, and the fluid injection tube 9 is pulled out; and the flexible electrode tube is extracted from the liquid injection hole 10 by uniformly pulling the two ropes 8 for next reuse.

Comparative Embodiment 1

A difference between this comparative embodiment and Embodiment 1 lies in the electrode tube used. In this comparative embodiment, the flexible electrode tube 1 is replaced with a conventional conductive plastic tube having a resistivity of $1.2\times10^{-3}$ Ω·m, without integrated recovery structures such as joint zones.

In this comparative embodiment, rare earths are mined according to the same process as Embodiment 1, yielding a total of 0.63 t over a 50-day period, with a 85% recovery rate and total power consumption of 2580 kW·h. Compared to Embodiment 1, this embodiment employs the conventional conductive plastic tube with relatively higher resistivity, thereby resulting in increased power consumption and a lower recovery rate.

After mining completion, this conductive plastic tube 2 is difficult to be pulled out from the fluid injection hole 10, leading to the inability to reuse.

Comparative Embodiment 2

A difference between this comparative embodiment and Embodiment 2 lies in the electrode tube used. In this comparative embodiment, the flexible electrode tube 1 is replaced with a conventional conductive plastic tube having a resistivity of $1.3\times10^{-3}$ ∩·m, without integrated recovery structures such as joint zones.

In this comparative embodiment, rare earths are mined according to the same process as Embodiment 2, yielding a total of 0.72 t over a 44-day period, with a 85% recovery rate and total power consumption of 2730 kW·h. Compared to Embodiment 2, this embodiment employs the conventional conductive plastic tube with relatively higher resistivity, thereby resulting in increased power consumption and a lower recovery rate.

After mining completion, this conductive plastic tube 2 is difficult to be pulled out from the fluid injection hole 10, leading to the inability to reuse.

As demonstrated by the foregoing embodiments, the flexible electrode tubes and the arrangement methods therefor provided by the embodiments of the present disclosure not only achieve high-efficiency rare earth mining with low power consumption, but also ensure electrode tube recovery and reuse, significantly reducing mining costs. It is to be noted that the above embodiments are only used for stating the technical solutions of the present disclosure, but not limitation. Although the present disclosure is described in detail by reference to the foregoing embodiments, for those ordinary skilled in the art, it is to be understood that the technical solutions described in the above embodiments may still be modified, or some or all of the technical features may be equivalently replaced. However, these modifications or substitutions do not deviate the essence of the corresponding technical solutions from the scope of the technical solutions of each embodiment of the present disclosure.

The invention claimed is:

1. An application method for a flexible electrode tube for electrified rare earth mining, wherein each adopted flexible electrode tube comprises a flexible conductive plastic tube, a wire, and a joint zone, the flexible conductive plastic tube and the joint zone are integrally formed, and the joint zone has a plurality of annular grooves; the wire is embedded inside a tube wall of the flexible conductive plastic tube in a spiral manner, uniformly distributed from top to bottom, causing the wire to uniformly and efficiently transmit current throughout the entire tube wall, shortening a current transmission distance within the flexible conductive plastic tube, and reducing the overall resistance of the flexible electrode tube; the flexible conductive plastic tube features an open bottom configuration and a smooth outer wall, with the wire being a single metal wire; and the flexible conductive plastic tube has an outer diameter of 40-80 mm, a wall thickness of 2-4 mm, and a tube length of 3-21 m; and the application method comprises the steps of: S1, drilling liquid injection holes in a mining area, each with a diameter of 40-80 mm, and a bottom positioned 1-2 m above a bottom of a rare earth orebody;

S2, slowly placing the flexible electrode tubes into the bottoms of the liquid injection holes, with top ends located at an interface between the rare earth orebody layer and a topsoil layer;

S3, inserting fluid injection tubes into the liquid injection holes to lengths precisely reaching the joint zones of the flexible electrode tubes, the fluid injection tubes serving primarily to introduce leaching agents into the flexible electrode tubes;

S4, fixing ropes connecting clamps to ground stand columns, inserting waterproof snap-fit joints of n cables into an n-to-1 waterproof connector, with $1<n<10$, transferring this connector to a main cable and connecting it to the corresponding positive or negative terminal of a direct current (DC) power supply, and performing electrified rare earth mining; and S5, unplugging the cables of the flexible electrode tubes from the n-to-1 waterproof connector after mining completion, pulling out the fluid injection tubes, and extracting the flexible electrode tubes from the liquid injection holes by pulling the ropes for later use.

2. The method according to claim 1, wherein during mining, the wires are connected to the waterproof snap-fit joints through the cables, the waterproof snap-fit joints are connected to the n-to-1 waterproof connector, the n-to-1 waterproof connector is connected to the DC power supply through the cables, a portion of the flexible electrode tubes are connected to the positive terminal of the DC power supply, and the remaining flexible electrode tubes are connected to the negative terminal of the DC power supply, with equal numbers of tubes connected to the positive terminal and the negative terminal.

3. The method according to claim 1, wherein the flexible conductive plastic tube is made from polyethylene, polypropylene, carbon black and graphite, with a mass ratio of 1:0.1-0.2:0.4-0.5:0.1-0.2, and exhibits a resistivity below $10^{-3}$ Ω·m.

4. The method according to claim 1, wherein the wire is copper or aluminum wires, with a cross-sectional area spanning 0.78-6 $mm^2$.

5. The method according to claim 1, wherein the spiral wire embedded inside the flexible conductive plastic tube has a lead pitch of 30-80 mm.

6. The method according to claim 1, wherein the joint zone is made from polyethylene, polypropylene, carbon black and graphite, with a mass ratio of 1:0.4-0.6:0.4-0.5:0.1-0.2, and exhibits a resistivity below $5\times10^{-3}$ Ω·m.

7. The method according to claim 1, wherein the joint zone has a length of 0.2-0.5 m, an outer diameter of 30-70 mm, a wall thickness of 10-20 mm; and 2-5 annular grooves are arranged on an outer wall of the joint zone, each having a depth of 4-15 mm and a width of 20-40 mm.

8. The method according to claim 1, wherein the grooves have the clamps, and the ropes for pulling are fixed to the clamps.

* * * * *